US011155431B2

(12) United States Patent
Domschat

(10) Patent No.: US 11,155,431 B2
(45) Date of Patent: Oct. 26, 2021

(54) WINDING MACHINE FOR WEB-TYPE MATERIALS AND METHOD FOR OPERATING SUCH A WINDING MACHINE

(71) Applicant: GEMA SWITZERLAND GMBH, St. Gallen (CH)

(72) Inventor: Klaus Domschat, Lörrach (DE)

(73) Assignee: GEMA SWITZERLAND GMBH, St. Gallen (CH)

( * ) Notice: Subject to any disclaimer, the term of this patent is extended or adjusted under 35 U.S.C. 154(b) by 349 days.

(21) Appl. No.: 16/379,780

(22) Filed: Apr. 9, 2019

(65) Prior Publication Data

US 2019/0308840 A1 Oct. 10, 2019

(30) Foreign Application Priority Data

Apr. 10, 2018 (DE) ..... 102018108485.4

(51) Int. Cl.

| | |
|---|---|
| ***B65H 26/00*** | (2006.01) |
| ***B65H 18/08*** | (2006.01) |
| ***B65H 19/22*** | (2006.01) |
| ***B65H 19/28*** | (2006.01) |

(52) U.S. Cl.

CPC ..... *B65H 26/00* (2013.01); *B65H 18/08* (2013.01); *B65H 19/2215* (2013.01); *B65H 19/28* (2013.01); *B65H 2301/4148* (2013.01); *B65H 2301/41421* (2013.01); *B65H 2301/5132* (2013.01); *B65H 2301/5133* (2013.01); *B65H 2301/51512* (2013.01); *B65H 2408/23152* (2013.01); *B65H 2553/232* (2013.01); *B65H 2601/20* (2013.01); *B65H 2701/1752* (2013.01); *B65H 2701/19* (2013.01)

(58) Field of Classification Search

None

See application file for complete search history.

(56) References Cited

U.S. PATENT DOCUMENTS 2,333,213 A * 11/1943 Slayter ..... H05F 3/04 361/213
2,868,989 A * 1/1959 Haacke ..... G03G 15/0291 250/325
2,951,968 A * 9/1960 Leupi ..... H05F 3/04 315/57

(Continued)

FOREIGN PATENT DOCUMENTS

DE 2404982 A1 8/1974
DE 8715861 U1 1/1988

(Continued)

OTHER PUBLICATIONS

German Office Action dated Nov. 19, 2020, received for corresponding German Application No. 102018108485.4, 7 pages.

(Continued)

*Primary Examiner* — William A. Rivera

(74) *Attorney, Agent, or Firm* — Kinney & Lange, P.A.

(57) ABSTRACT

A winding machine for web-type materials, in particular film materials, comprises a feeding device and at least one winding shaft which is capable of being driven and designed to receive a winding core for the winding of the web-type film material, wherein the winding machine is allocated a system for regulating and/or reducing an electrostatic charge of the web-type material during the winding process.

10 Claims, 3 Drawing Sheets

(56) References Cited

U.S. PATENT DOCUMENTS 3,308,045 A * 3/1967 Sullivan ..... H01T 19/00 204/165
RE26,951 E * 9/1970 Vaccaro ..... D21H 5/0005 118/695
3,787,706 A * 1/1974 De Geest ..... H05F 3/04 361/212
3,863,108 A * 1/1975 Blythe ..... B29C 48/9165 361/212
4,271,451 A * 6/1981 Metz ..... H01T 19/04 361/213
4,363,070 A * 12/1982 Kisler ..... H05F 3/02 361/212
RE31,382 E * 9/1983 Moore ..... H05F 3/04 361/213
4,486,808 A * 12/1984 Cardone ..... H05F 3/04 361/214
5,121,285 A * 6/1992 McClure ..... G03G 15/6591 361/212
5,592,357 A * 1/1997 Rader ..... B01D 39/083 361/225
5,845,867 A * 12/1998 Hould ..... B65H 19/2223 242/527
5,949,635 A * 9/1999 Botez ..... H01T 19/04 361/213
6,273,356 B1 * 8/2001 Burton ..... B65H 19/2223 242/527.3
6,917,507 B2 * 7/2005 McClintock ..... B65H 16/00 361/214
8,181,898 B2 * 5/2012 Lombardini ..... B65H 19/2223 242/533.4
2002/0153447 A1 * 10/2002 Perrigo ..... B65H 19/2207 242/523.1
2004/0238906 A1 12/2004 McClintock et al.
2005/0127231 A1 * 6/2005 Pasquale ..... B65H 19/30 242/533.6
2014/0092518 A1 * 4/2014 Robinson ..... B65H 16/00 361/212
2015/0296601 A1 * 10/2015 Domschat ..... H05F 3/00 361/220
2016/0185549 A1 * 6/2016 Roska ..... B65H 20/02 226/1

FOREIGN PATENT DOCUMENTS

DE 10116973 A1 10/2002
DE 10202462 A1 5/2003
DE 102011007136 A1 10/2012

OTHER PUBLICATIONS

Examination Report dated Dec. 20, 2018, for corresponding German Application No. 102018108485.4.

* cited by examiner

WINDING MACHINE FOR WEB-TYPE MATERIALS AND METHOD FOR OPERATING SUCH A WINDING MACHINE

CROSS-REFERENCE TO RELATED APPLICATION(S)

This application claims the benefit of German Application No. 10 2018 108 485.4 filed on Apr. 10, 2018, the disclosure of which is incorporated herein by reference in its entirety.

BACKGROUND

The present disclosure relates to a winding machine for web-type materials, in particular film materials, as well as a method for operating such a winding machine. The winding machine is in particular designed as a so-called turret winder which, in addition to the winding position, has at least one second position for the removal of a finished roll for the continuous winding of a material web. Such a winding machine can also can also be run in inline operation within production lines producing a full material web.

For example, a film winding machine is known from the JP 2002 020004 A printed publication in which two laterally arranged drive shafts are provided to each receive a respective winding core for winding two film rollstocks onto two coaxially arranged winding cores.

The present disclosure is based on the problem of the currently existing winding machines only being conditionally suitable—if at all—for winding battery separator films without risk of damaging or qualitatively devaluating the separator films.

The present disclosure is based at least in part on the realization that during the processing of in particular high-quality battery separator films, an electrostatic charging of the films is generally unavoidable. The buildup of such an electrostatic charge usually leads to a corresponding electrostatic discharge, whereby high, in particular electrical, energies are released. This can for example take the form of sparks or brief flows of high electrical currents respectively. Such a discharge poses a danger and can in particular damage and may possibly at least partly destroy the electrostatically charged or discharged film material.

SUMMARY

The present disclosure specifies a winding machine for web-type materials, in particular film materials, for example battery separator films, wherein the winding machine comprises a feeding device and at least one winding shaft which is capable of being driven and designed to receive a winding core for the winding up of the web-type film material. The winding machine is furthermore allocated a system for regulating and/or reducing an electrostatic charge of the web-type material during the winding process.

Said system aids in effectively regulating or respectively reducing the electrostatic charge of the film material during the winding process so as to be able to effectively prevent the film material from experiencing a damaging electrostatic discharge.

The disclosed solution is characterized in particular by a particularly compact system being able to regulate the electrostatic charge of the film material, which significantly reduces the costs and space requirement for the winding machine. The system can insofar be of particularly compact realization since the individual system components are assigned multiple functions. Thus, the system for regulating and/or reducing an electrostatic charge of the web-type material is in particular realized as an electrostatic discharging/charging device designed to electrostatically discharge the web-type material wound onto the winding core accommodated by the at least one winding shaft as needed.

The electrostatic discharging/charging device may comprise an active positive electrode array having a plurality of active needle-like individual positive electrodes and which is electrically connected to a positive high-voltage source during the operation of the electrostatic discharging/charging device. Further-more, the electrostatic discharging/charging device may comprise an active negative electrode array having at least two active needle-like individual negative electrodes and which is electrically connected to a negative high-voltage source during the operation of the electrostatic discharging/charging device. The electrostatic discharging/charging device may additionally comprise a sensor electrode array having at least two needle-like individual sensor electrodes and which is electrically connected to a ground during the operation of the electrostatic discharging/charging device.

According to embodiments of the present disclosure, the electrostatic discharging/charging device can also be a part of an applying unit which is designed to lay a new web material start onto an empty winding core accommodated by the at least one winding shaft and/or which is designed to allow an end of the web material to electrostatically adhere to a fully wound winding core.

According to embodiments of the disclosed winding machine, the system for regulating and/or reducing the electrostatic charge comprises an electrostatic discharge system allocated to the feeding device of the winding machine which serves and is designed to electrostatically discharge the web-type film material to be fed onto the winding core accommodated by the winding shaft of the winding machine.

According to embodiments, the disclosed winding machine further comprises a contact roller unit in order to feed the web-type material to a winding core accommodated by the at least one winding shaft at a winding point. It is thereby advantageous for the electrostatic discharge system allocated to the feeding device to be arranged upstream—as seen in the transport direction of the web material—of the contact roller unit.

A sensor system is advantageously allocated to the electrostatic discharge system associated with the feeding device by means of which the amount of electrostatic charge and/or polarity of an electrostatic charge of the web-type film material can be detected in order to be able to appropriately control the electrostatic discharge system associated with the feeding device. Conceivable in this context is for the system for regulating and/or reducing the electrostatic charge to comprise a device for detecting the amount of electrostatic charge and/or polarity of an electrostatic charge of the web-type film material. Said device is preferably a component of the electrostatic discharge system.

Particularly conceivable in this context is for the electrostatic discharge system to comprise an active positive electrode array which has a plurality of active needle-like individual positive electrodes and which is connected to a positive high-voltage source during the operation of the electrostatic discharge system, and an active negative electrode array which has at least two active needle-like individual negative electrodes and which is electrically connected to a negative high-voltage source during the operation of the electrostatic discharge system. In this embodiment, the device for detecting the amount of electrostatic charge and/or polarity of an electrostatic charge of the web-type film material can for example comprise a sensor electrode array having at least two needle-like individual sensor electrodes and which is electrically connected to a ground during the operation of the electrostatic discharge system.

As already indicated at the outset, the disclosed winding machine is in particular designed as a turret winder and has at least two winding shafts, each of which are drivable and designed to receive a winding core. It is thereby conceivable for the winding shafts with accommodated winding cores to be conveyed between a winding position for winding the material web onto a winding core accommodated by one of the winding shafts and a unload/load position for the removal of a fully wound winding core or for supplying an empty winding core respectively.

It is particularly applicable in this context for the winding machine to further comprise a cross-cutting device for cutting through the web-type material during or at the end of a winding process and/or during or at the start of a turning procedure, whereby the cross-cutting device can be moved, in particular displaced or pivoted, relative to the winding core accommodated by the at least one winding shaft. An applying device is in particular allocated to the cross-cutting device, the former being configured to lay a new web material start onto an empty winding core accommodated by the at least one winding shaft, whereby the applying device is allocated to an electrostatic discharging/charging device associated with the system for regulating and/or reducing an electrostatic charge.

According to embodiments, the electrostatic discharging/charging device of the applying device is further designed to electrostatically discharge the web-type material wound onto the winding core accommodated by the at least one winding shaft as needed.

Alternatively or additionally thereto, it is conceivable for an electrostatic discharging/charging device associated with the system for regulating and/or reducing an electrostatic charge to be provided which is designed to electrostatically charge an end of the material web such that it adheres to the respective finished roll.

According to one preferential realization of the winding machine or the system for regulating and/or reducing an electrostatic charge allocated to the winding machine respectively, it is provided for the electrostatic discharging/charging device of the applying device to comprise an active positive electrode array, an active negative electrode array, and a sensor electrode array. The active positive electrode array comprises a plurality of active needle-like individual positive electrodes which are electrically connected to a positive high-voltage source during the operation of the discharging/charging device. The active negative electrode array of the electrostatic discharging/charging device comprises a plurality of active needle-like individual negative electrodes which are electrically connected to a negative high-voltage source during the operation of the discharging/charging device. The sensor electrode array comprises a plurality of needle-like individual sensor electrodes which are electrically connected to a ground during the operation of the discharging/charging device.

According to embodiments of the disclosed winding machine, the same comprises a control device which is allocated to the system for regulating and/or reducing an electrostatic charge. The control device is in particular designed to control the electrostatic discharge system associated with the feeding device and/or the electrostatic discharging/charging device associated with the cross-cutting device during a winding process so as to at least reduce an electrostatic charge of the web-type material.

According to a further development thereof, the control device is further designed to control the electrostatic charging/discharging device associated with the cross-cutting device subsequent to the cross-cutting device cutting the web-type material such that a new web material start is electrostatically charged for the purpose of laying the new web material start on an empty and preferably grounded winding core accommodated by the at least one winding shaft.

BRIEF DESCRIPTION OF THE DRAWINGS

The following will reference the accompanying drawings in describing an exemplary embodiment of the disclosed winding machine in greater detail.

Shown are.

DETAILED DESCRIPTION

Figure 1:
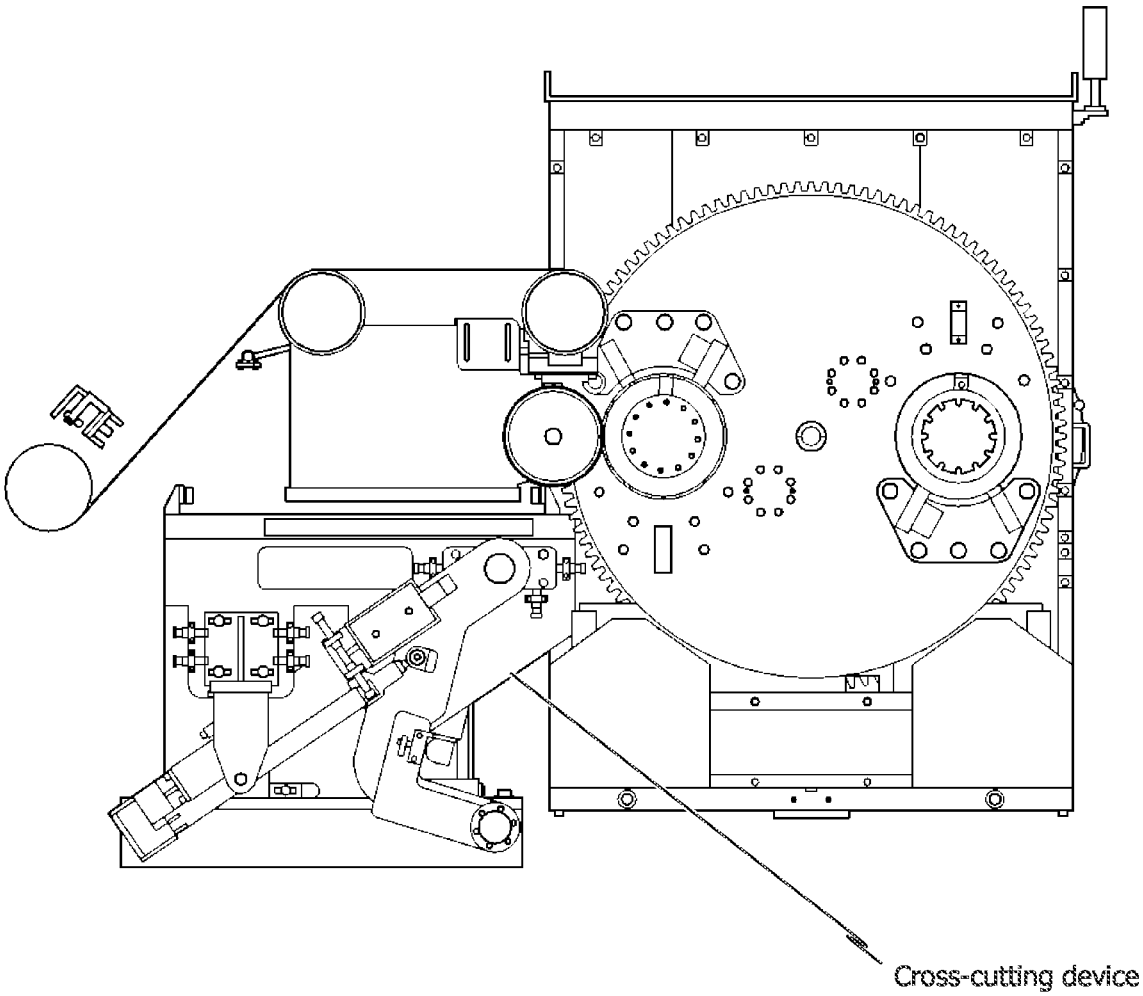
FIG. 1 the schematic structure of an exemplary embodiment of the winding machine according to the present disclosure.

An exemplary embodiment of the disclosed winding machine is shown schematically in FIG. 1. The winding machine serves in the rolling or winding up of a web-type material, particularly film material, so it will subsequently be in rolled form. To that end, the winding machine has a machine frame to which the individual components and units, as described in particular in the following, are secured or respectively mounted.

A module of the winding machine referred to as a feeding device serves in supplying the web-type material. The feeding device comprises a series of rolls or rollers not specified in any greater detail. They serve in redirecting the web-type material supplied at the upper region of the winding machine.

This feed to the winding machine can come for example directly from a production line or also from prefabricated rolls of the web-type material which are for example to be rewound into smaller units in the form of smaller spools or rolls. The material feed can, for example, additionally incorporate measuring devices as well as even tensioning devices.

The winding machine depicted schematically in FIG. 1 is a so-called "turret winder." It serves to continuously wind up the web-type material and has, additionally to the winding position, at least one second position for extracting the finished roll. To that end, the winding machine depicted schematically in FIG. 1 is provided with a pivot mount as a pivoting frame which has two winding shafts (a greater number of winding shafts can of course also be provided). Said pivot mount is thereby designed like a turret. The two winding shafts are thereby spatially dispersed in the vicinity of the pivot mount's outer circumferential region at an angle of 180°.

Each winding shaft serves in receiving a respective winding core. The winding machine winds the web-type material onto said winding cores. The winding shafts are thereby designed so as to be drivable. A common or a separate drive can in effect be provided for each of the winding shafts.

While the winding cores are releasably positioned on the winding shafts, they are rotationally fixed to the winding shafts. For example, the winding cores can be fit onto the winding shafts and clamped there by corresponding tensioning elements of the winding shafts. The winding shafts can comprise the respective tensioning elements thereto which enable varying the external cross section of the respective winding shaft. The winding shafts can consequently be expanded inside the winding cores and thus braced. Alternatively or additionally thereto, suitable engaging elements can also be provided on the winding cores and the winding shafts, for example in the form of a tooth system.

In the FIG. 1 depiction, the left position of the winding shaft, at which a corresponding winding up of the web-type material occurs, is also referred to as "winding point" or "winding position." In contrast, the right position of the winding shaft is the "extraction point" or "extraction position" at which one or more filled winding cores can be removed and an empty winding core pushed onto the winding shaft.

In order to be able to bring the pivot mount and in particular a winding core into an appropriate position for supplying, winding and respectively removing a winding core at the relevant points, the pivot mount is driven. The most outermost circumference of the lateral spur wheels is to that end provided with a sprocket. A corresponding toothed wheel of a drive engages with this sprocket. The pivot mount can thereby rotate about a central horizontal axis of rotation. Both winding shafts can thus each be moved or pivoted from one position into the next.

The actual feed of the web-type material to the respective winding core to be wound is effected by means of a contact roller unit. The contact roller unit thereby acquires the web-like material from the feeding device. The web-like material is then advanced to the winding core at the winding point by means of respective rollers of the contact roller unit. This can ensue, particularly when starting up the winding machine, with freely running web-type material. In the course of production, however, the contact roller unit is advanced to the winding core with the web-type material already wound thereon such that an optimal winding result is achieved by the pressing provided by a pressure roller or contact roller. Smooth positioning of the layers atop one another on the one hand and a reduction in air pockets between the layers on the other hand is thereby in particular optimized.

For the further optimizing of the winding result, the exemplary embodiment of the disclosed winding machine comprises a system as described in greater detail below for regulating and/or reducing an electrostatic charge of the web-type material during the winding process.

Part of said system comprises on the one hand an electrostatic discharge system allocated to the feeding device which serves to electrostatically discharge the web-type material to be supplied to the winding shaft at the winding point. In the embodiment of the disclosed winding machine shown in FIG. 1, this electrostatic discharge system is arranged above the web-type material and thus serves in electrostatically discharging the upper side of the web-type material.

A suitable sensor system is furthermore provided in order to provide an electrostatic charge magnitude and/or an electrostatic charge polarity for the web-type material. In the embodiment of the disclosed winding machine schematically depicted in FIG. 1, the sensor system is preferably designed in the form of a sensor electrode array which comprises at least two needle-like individual sensor electrodes and which is electrically connected to a ground during the operation of the electrostatic discharge system.

This sensor system advantageously detects the electrostatic charge of the web-type material and preferably appropriately controls the electrostatic discharge system associated with the feeding device by means of a control loop so as to minimize the electrostatic charge of the web-type material.

For example, when changing the winding cores or the resulting roll of web-type material respectively (the so-called finished roll), the web-type material is to be cut. In order to be able to do so during operation, a cross-cutting device is provided. Said cross-cutting device is—as is also the contact roller unit—dis-placeably mounted within the machine frame by means of a separate rail system. Alternatively or additionally thereto, it is conceivable for the cross-cutting device to also be of pivoting design relative to the winding shaft at the winding point.

The cross-cutting device is preferably provided with a suitable height-adjustable cutter head. Said cutter head enables cutting through the web-type material across the length of the web during operation. The cutting thereby typically ensues in the area of the contact roller unit since the contact roller unit holds the web-type material securely in this area so that the cutter head of the cross-cutting device can make a smooth cut. The cross-cutting device with cutter head can thereto comprise a cutting roller or a blade roller incorporating a blade. Said blade is thereby typically designed as a serrated blade extending along the blade roller.

Both the contact roller unit as well as the cross-cutting device are—as already indicated—movably mounted on corresponding rail systems. This in particular enables linear movement along the rail systems. A separate drive is usually provided for each of these units.

A roller table, not shown in detail in FIG. 1, can serve in the extraction of a winding core typically filled with web-type material up to a predefined fill level or winding diameter respectively from the winding machine.

When changing rolls while the winding machine is in motion and/or upon starting up, an initial area of the web-type material (web material start) is wound onto a first winding core. It may be necessary to first fix same to the winding core; this ensuing according to the present disclosure via electrostatic forces. The winding process is then initiated by the rotating of the winding shaft with the winding core arranged thereon. If necessary, the contact roller of the contact roller unit can then be moved in toward the winding core in order press against the web-type material.

To lay the start of a new web material onto an empty winding core accommodated on the corresponding winding shaft at the winding point, an appropriate applying device is employed which comprises an electrostatic discharging/charging device associated with the system for regulating and/or reducing an electrostatic charge. Said electrostatic discharging/charging device not only serves in laying down the new web material start on the new empty winding core during a roll change while in motion but also in electrostatically discharging the web-type material wound onto the winding core accommodated on the at least one winding shaft if necessary.

Alternatively or additionally thereto, it is conceivable for the electrostatic discharging/charging device associated with the system for regulating and/or reducing an electrostatic charge to be designed to electrostatically charge an end of the web material so that it adheres to the respective finished roll.

Specifically, the discharging/charging device preferably comprises an electrode unit in which a plurality of electrodes are arranged in opposition to the web-type material to be statically discharged. The electrodes can be individual electrodes. However, as depicted, a plurality of electrodes can be arranged in the direction of movement of the web-type material to be statically discharged or in a direction perpendicular thereto.

The electrode is structured in such a way that a pair of electrode needles face each other in a retaining element made of insulating material, whereby individual positive and negative voltages are fed to the electrode needles. Each electrode needle is connected to a voltage feed to that end. A control device to be described further below operates such that a high positive voltage is for example supplied to a first electrode needle of the electrode needles and a high negative voltage of reverse polarity is supplied to a second electrode needle. Generally speaking, one of the electrode needles is fed a high voltage and the respective other electrode needle is connected to ground. The electrode needle connected to ground is connected to the same ground level as the machine frame of the winding machine.

An air outlet can be provided between the pair of electrode needles in order to blow a stream of air against the web-type material to be statically discharged. The air outlet is connected to a (not shown) fan or the like for blowing out a stream of air. When such an air outlet is provided, the airflow can drive the positive or negative ions produced between the pair of electrode needles out of the one air outlet in the vicinity of the web-type material to be statically discharged, thereby achieving static discharge at high efficiency.

The electrostatic discharging/charging device further comprises a sensor which is provided in the vicinity of the web-type material to be statically discharged and serves to measure or respectively detect the charge polarity and the amount of charge based on a surface potential of the web-type material to be statically discharged. The sensor is connected to the control device in order to control the voltages fed to the electrode needles on the basis of the sensor's output signal.

According to one configuration, the control device controls a switching to be executed in a short interval of time between a supply state, in which one of the electrode needles is fed a high positive or negative voltage and the other electrode needle is connected to ground, and a supply state in which the electrode needle being fed the high voltage is connected to ground and the electrode needle connected to ground is fed a high voltage of reverse polarity to the high voltage of the other electrode needle. This switching can for example occur within the range of several hertz such as e.g. 33 Hz or 22 Hz. The sensor would not be necessary in this case.

When the high voltage to be fed to the electrode needles is controlled by the use of the control device, the positive and negative ions affect the web-type material to be statically discharged. Of these ions, only the ions with opposing polarity to the charge polarity of the web-type material to be statically discharged are absorbed by the material so as to provide efficient static discharge. Although the static discharge speed is slightly slower than in the case of the second discharging/charging device described below, efficient static discharge can be achieved without opposite polarity charge.

In contrast, if in the alternative embodiment of the electrostatic discharging/charging device, the amount of charge of the web-type material to be statically discharged exceeds a predetermined control value, as detected by the sensor, the control device supplies a high voltage to the electrode needle, being fed a high voltage at an opposite polarity to the charge polarity of the web-type material and connects the other electrode needle to ground in order to generate positive or negative ions for static discharge based on the high voltage of the electrode needle. When as a result of ion static discharge, the sensor detects that the amount of charge reaches or falls short of the threshold value, the control device controls the voltage supply so as to interrupt the high voltage feed.

If, however, the discharging/charging device has to take over the function of the applying device during a roll change while in motion, the control device controls the electrode needles such that the web-type material is electrostatically charged and thus enables the start of the web material to electrostatically adhere to the new, preferably grounded, empty winding core.

The following will briefly summarize the sequence of an automatic turning procedure in the exemplary embodiment of the disclosed winding machine. First, the web-type material is wound to a maximum diameter at the winding point of the winding core. During this phase, the electrostatic discharge system allocated to the feeding device of the winding machine is activated in order to electro-statically discharge the web-type material to be fed to the winding shaft. In addition, the electrostatic discharging/charging device allocated to the cross-cutting device is activated. To that end, the corresponding cutting arm with the discharging/charging device is accordingly advanced to the winding point relative to the winding shaft.

Upon the maximum diameter of the first winding core being reached, the same is conveyed to the extraction point/extraction position, the web-type material then runs further over the second winding core and continues being wound up onto the first winding core. The cutting arm of the cross-cutting device subsequently pivots up to about 30 mm to the first winding core, which is in the extraction position, in order to cut through the web-type material. The web-type material is thereby led upward by a guide roller at the end of the pivot arm of the cross-cutting device.

At this point in time, the electrostatic discharging/charging device allocated to the cross-cutting device is activated such that it assumes its function as applying device. The activation for example occurs for a period of 5 to 15 seconds and serves the purpose of the new web material start adhering to the new (second) empty winding core situated at the winding point.

Deemed a significant advantage of the system for regulating and/or reducing an electrostatic charge of the web-type material during the winding process as provided in the disclosed winding machine is that the electrostatic discharging/charging device allocated to the cross-cutting device is accorded the previously described dual function such that the total system costs can be significantly reduced.

Moreover, the system can help in significantly optimizing the winding result, particularly when film material, such as for example separator films for lithium ion batteries, is utilized as the web-type material.

Figure 2:
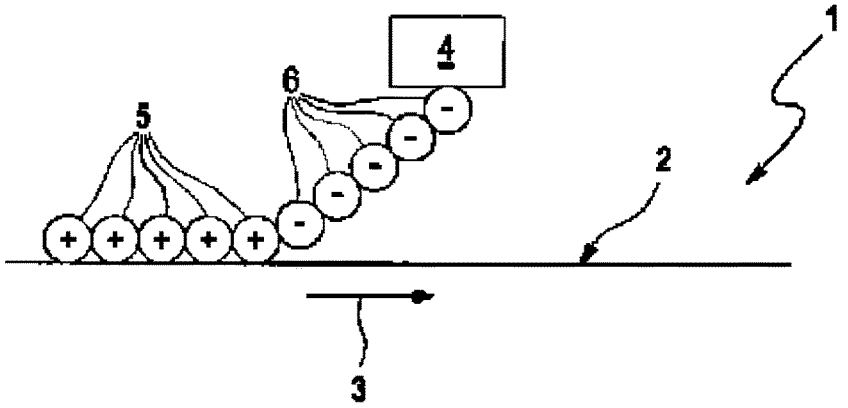
FIG. 2 a highly simplified view of an exemplary embodiment of the system for regulating and/or reducing an electrostatic charging of the web-type material as employed in the disclosed winding machine.

FIG. 2 shows a highly simplified exemplary embodiment of a system for regulating and/or reducing an electrostatic charge of the web-type material, whereby this system is used with a winding machine, in particular the winding machine shown previously with reference to the representation in FIG. 1. As depicted, the web-type material 2 is moved in direction of movement 3, wherein the system for regulating and/or reducing an electrostatic charge can selectively reduce and preferably eliminate an electrostatic charge of the material web 2. The system is also referred to as "antistatic device 4" in the following.

Solely as an example, FIG. 2 indicates five positive charge units 5 ahead of the antistatic device 4 with respect to direction of movement 3 which, based on the production design, carries along the material web 2. Five negative charge units 6 produced via the antistatic device 4 are indicated in the region of antistatic device 4 and effect a neutralizing of the five positive charge units 5. In the ideal case shown in FIG. 2, the material web 2 has no charge or is respectively charge-neutral with respect to its direction of movement 3 downstream of the antistatic device 4. The material web 2 is for example fed to the winding core accommodated by the at least one winding shaft of the winding machine in this uncharged or respectively charge-neutral state.

Figure 3:
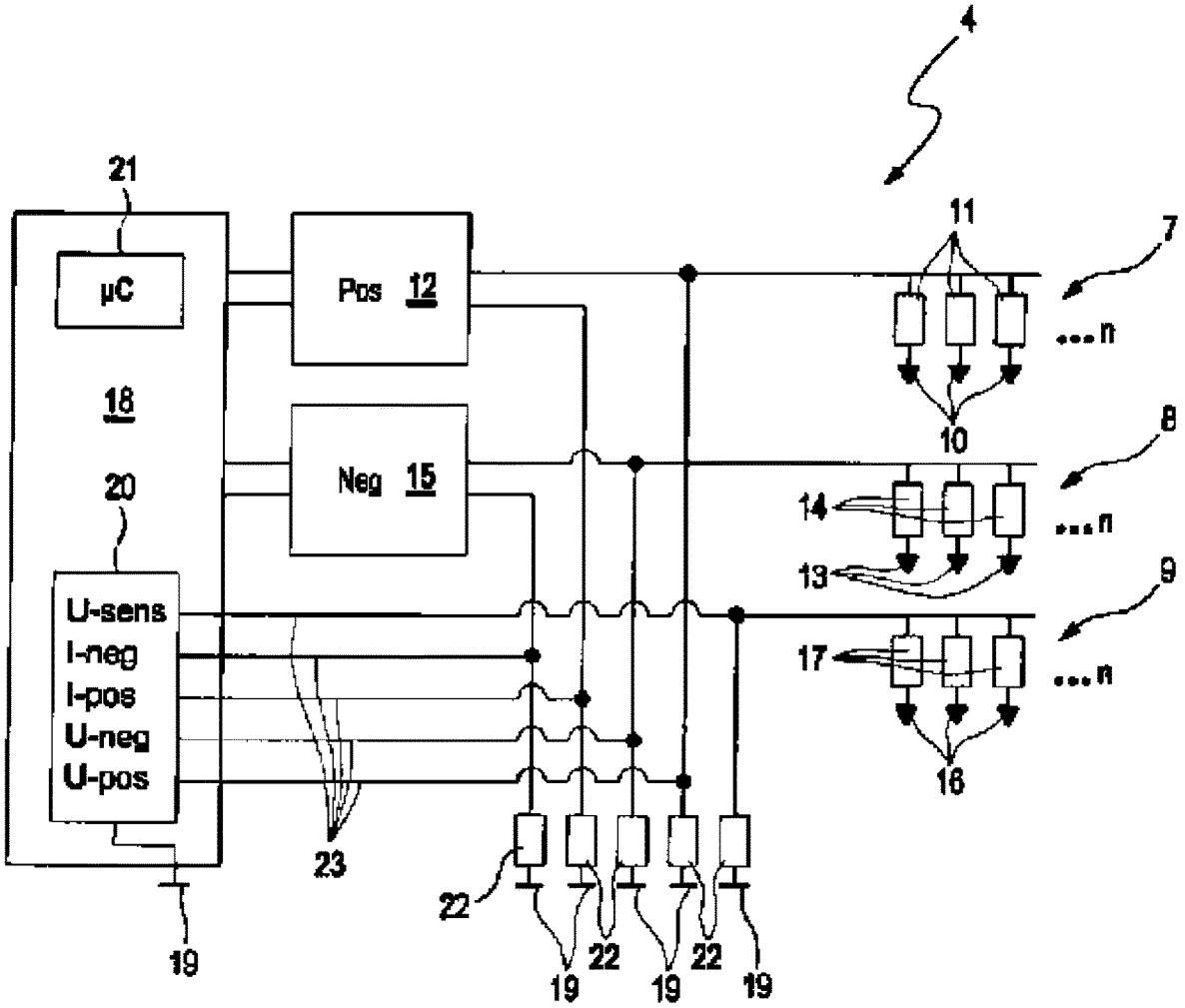
FIG. 3 a schematic block diagram of the system for regulating and/or reducing an electrostatic charge.

According to the schematic block diagram of the antistatic device 4 as per FIG. 3, the antistatic device 4 comprises an active positive electrode array 7, an active negative electrode array 8 and a sensor electrode array 9. The positive electrode array 7 comprises a plurality of active needle-like individual positive electrodes 10, each of which is allocated a series resistor 11 in FIG. 3, and which are electrically connected to a positive high-voltage source 12. The negative electrode array 8 comprises a plurality of active needle-like individual negative electrodes 13, each of which is allocated a series resistor 14 as per the representation in FIG. 3, and which are electrically connected to negative high-voltage source 15.

The sensor electrode array 9 comprises a plurality of needle-like individual sensor electrodes 16 which are allocated individual resistors 17 in FIG. 3, and which are electrically connected to a grounding 19. The grounding 19 is normally a ground connection. The positive electrode array 7 and the negative electrode array 8 can also be referred to as ionization electrode arrays 7, 8.

A controller 18 cooperates with a sensor system 20 by means of which a polarity of a neutralizing current of the sensor electrode array 9 can be detected during the operation of the antistatic device 4. The controller 18 serves to control the high-voltage sources 12, 15 and is appropriately coupled to the sensor system 20. In the given example, the sensor system 20 is integrated into the controller 18.

To evaluate the signals identified by way of the sensor system 20 or to control the high-voltage sources 12, 15 respectively, the controller 18 can comprise a corresponding microprocessor 21.

A plurality of measuring resistors 22 can additionally be seen in the block diagram according to FIG. 3 via which the electrode arrays 7, 8, 9 and the high-voltage sources 12, 15 are connected to the grounding 19, wherein parallel sensor lines 23 able to detect the currents flowing through their grounding 19 run to the controller 18 or to the sensor system 20 respectively.

In conjunction with the sensor electrode array 9, the sensor system 20 can thus detect the charge polarity of the material web 3 via the polarity of the neutralizing current of the sensor electrode arrangement 9. Since the sensor electrodes 16 are connected to the grounding 19 via their series resistors 17 and measuring resistor 22, the sensor electrode array 9 functions like a passive neutralizing electrode array, whereby a neutralizing current flows when the material web 2 is charged accordingly.

The polarity of the charge on the material web 2 can be determined by determining the polarity of the neutralizing flow. The controller 18 can then deactivate the respective unnecessary active electrode array 7, 8 as a function of the determined polarity. For example, the neutralizing flow polarity of sensor electrode array 9 can be negative, which indicates a negative charge of the material web 2. As a result, the controller 18 activates the positive high-voltage source 12 and thus positive electrode array 7. At the same time, the negative high-voltage source 15 and thus negative electrode array 8 are deactivated.

If, however, it is determined that the neutralizing flow of the sensor electrode array 9 is positive, a positive charge of the material web 2 can be concluded. As a result, the controller 18 effects a deactivating of positive high-voltage source 12 and thus a deactivation of positive electrode array 7, while at the same time the negative high-voltage source 15 is activated and the negative electrode array 8 is activated.

The controller 18 preferably controls the respectively activated high-voltage source 12/15 during at least one operational phase such that a non-pulsed direct current, which is also preferably constant, is applied to the respectively active electrode array 7, 8.

An advantageous approach able to be realized with the aid of controller 18 will be described in greater detail with respect to the voltage/time diagram according to FIG. 4. The controller 18 is correspondingly configured or programmed thereto respectively. In the diagram shown in FIG. 4, the X-axis defines a time axis t while the Y-axis shows the voltage U on the active electrode arrays 7, 8. The voltage curve of the positive electrode array 7 thereby lies in the positive section of the Y-axis while the voltage curve of the negative electrode array 8 is shown in the negative section of the Y-axis.

The time axis t is divided into a learning phase 24 and a working phase 25. During the learning phase 24, which begins at time t0, the controller 18 for example effects the feeding of positive voltage pulses 26 to the positive electrode array 7 by the positive high-voltage source 12. At the same time, the negative high-voltage sources 15 feed negative voltage pulses 27 to the negative electrode array 8. The positive voltage pulses 26 and the negative voltage pulses 27 are thereby advantageously as far out of phase with each other in time that a type of square-wave AC voltage is applied across both active electrode arrays 7, 8. In other words, the positive voltage pulses 26 simultaneously position with the gaps 28 between adjacent negative voltage pulses 27. Conversely, negative voltage pulses 27 also position so as to simultaneously position with the gaps 29 between adjacent positive voltage pulses 26.

During the learning phase 24, the controller 18 in conjunction with the sensor system 20 determines the polarity of the neutralizing flow of the sensor electrode array 9.

Figure 4:
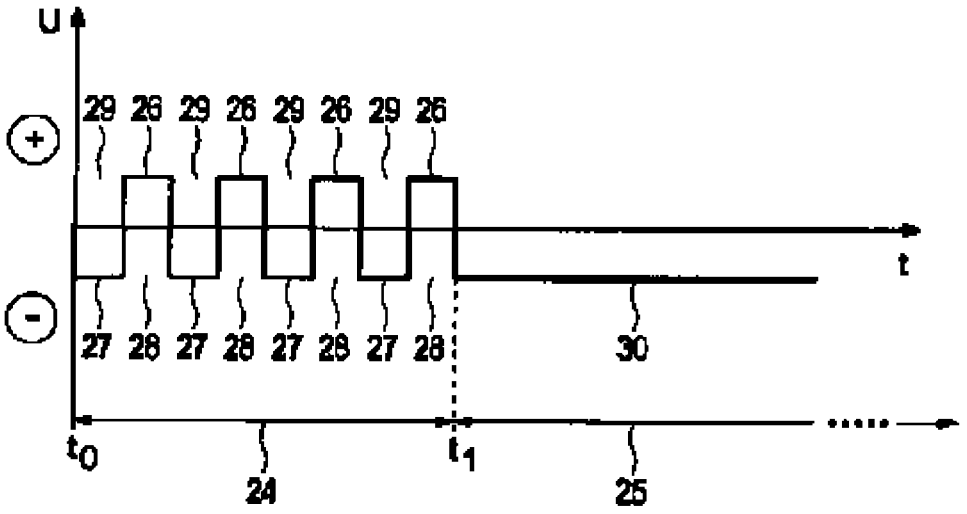
FIG. 4 a schematic voltage/time diagram for illustrating different operating phases of the system for regulating and/or reducing an electrostatic charge.

In the example of FIG. 4, a positive polarity is determined such that a switch is made from the learning phase 24 to the working phase 25 at time t1.

In the working phase 25, the positive high-voltage source 12 is deactivated in the case of positive polarity to the neutralizing flow of the sensor electrode array 9 so that voltage is no longer being fed to the positive electrode array 7. At the same time, the negative high-voltage source 15 is controlled such that it produces a non-pulsed negative DC voltage 30 as of said time t1.

Another embodiment can provide for both ionization electrode arrays 7, 8 to be deactivated during the learning phase 24. As soon as the sensor electrode array 9 is able to determine a neutralizing flow of stable polarity, the controller 18 can activate the respectively required ionization electrode array 7, 8.

During the working phase 25, the neutralizing flow of the respectively active electrode array 7, 8 can for example be continuously monitored. In the example of FIG. 4, the neutralizing flow of activated negative electrode array 8 is thus monitored during the working phase 25. If irregularities or predetermined events occur in the space of the neutralizing flow, the controller 18 can switch from the current mode of operation to another mode of operation. The controller 18 advantageously changes from the working phase 25 back into the learning phase 24, in which both high-voltage sources 12, 15 are active, and the two active electrode arrays 7, 8 are advantageously fed pulsed DC voltage 26, 27.

At the same time or alternatively, a degree of electrode burn-off and/or a degree of electrode contamination can also be monitored by measuring a quiescent current of the respectively active electrode array 7, 8 and/or the sensor electrode array 9.

The monitoring of the quiescent current is advantageously performed during a diagnostic phase which is for example activated or actuated every time the material web 2 starts, for example after a material web being changed. When the material web 2 starts up, or respectively the material web 2 is stationary, no or only a very low static charge can occur so that there are in particular no ionic currents from one of the active ionization electrodes 7, 8 to the material web. The same also applies to the passive sensor electrode array 9.

In contrast, ionic currents between the negative electrode array 8 and the positive electrode array 7 as well as between the sensor electrode array 9 and at least one of the ionization electrode arrays 7, 8 occur through the air. These quiescent currents vary significantly depending on contaminants and also correlate to the burn-off of the electrodes 10, 13, 16, respectively to the burn-off of the tips of the electrodes 10, 13, 16.

Figure 5:
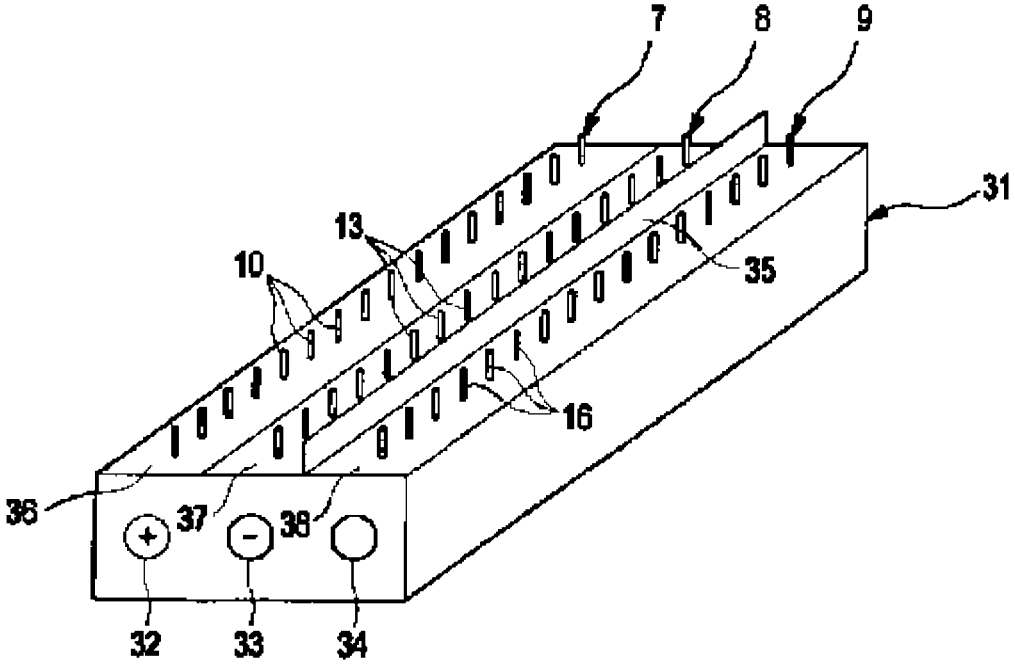
FIG. 5 a schematic isometric view of an electrode support of the system for regulating and/or reducing an electrostatic charge.

According to the representation in FIG. 5, the positive electrode array 7, the negative electrode array 8 and the sensor electrode array 9 can be arranged in or on a common electrode support 31. The electrode support 31 then comprises a positive connection 32 for connecting the positive electrode array 7 to the positive high-voltage source 12, a negative connection 33 for connecting the negative electrode array 8 to the negative high-voltage source 15, and a sensor connection 34 for connecting the sensor array 9 to the sensor system 20.

In the embodiment according to FIG. 5, the electrode support 31 can comprise a dividing wall 35 which can in particular be of electrically insulating configuration and extend between the two active electrode arrays 7, 8 on the one side and the sensor electrode array 9 on the other. This can thereby prevent a short-circuit through the air between the two active electrode arrays 7, 8 and the passively operating sensor electrode array 9. In order to improve this effect, the dividing wall 35 can be structured so as to project over the electrodes 10, 13, 16 or over their tips respectively toward the material web 2.

In the embodiment shown in FIG. 5, the individual positive electrodes 10 are arranged in a straight positive electrode row 36. The negative electrodes 13 are arranged in a straight negative electrode row 37 and the sensor electrodes 16 are arranged in straight sensor electrode row 38. FIG. 5 thus shows an embodiment with three separate electrode rows 36, 37, 38 which are positioned one behind the other in the assembled state of the antistatic device 4 relative to the direction of movement 3 of the material web 2, whereby the rows 36, 37, 38 then extend transverse to the direction of movement 3.

The disclosure not only relates to a winding machine described above by way of an example referencing the drawings but also to a corresponding method for operating a winding machine, in particular a winding machine as herein.

Moreover, the present invention is not limited to the exemplary embodiment(s) but rather yields from a consideration of all the features disclosed herein in context.

The invention claimed is:

1. A winding machine for web material, comprising:

a feeding device; and at least one winding shaft which is capable of being driven and designed to receive a winding core for winding of the web material, wherein the winding machine is allocated a system for regulating and/or reducing an electrostatic charge of the web material during the winding process;

wherein the winding machine further comprises a cross-cutting device for cutting through the web material during or at an end of a winding process and/or during or at a start of a turning procedure, wherein the cross-cutting device can be displaced or pivoted relative to the winding core accommodated by the at least one winding shaft;

wherein the cross-cutting device is allocated an applying device for laying a new web material start onto an empty winding core accommodated by the at least one winding shaft, wherein the applying device comprises an electrostatic discharging/charging device associated with the system for regulating and/or reducing the electrostatic charge; and wherein the electrostatic discharging/charging device of the applying device is configured to selectively electrostatically discharge the web material wound onto the winding core accommodated by the at least one winding shaft, wherein the electrostatic discharging/charging device comprises:

an active positive electrode array comprising one or more active needle-like individual positive electrodes, and which is electrically connected to a positive high-voltage source during operation of the electrostatic discharging/charging device;

an active negative electrode array comprising at least two active needle-like individual negative electrodes, and which is electrically connected to a negative high-voltage source during operation of the discharging/charging device; and a sensor electrode array comprising at least two needle-like individual sensor electrodes, and which is electrically connected to a ground during operation of the discharging/charging device.

2. The winding machine according to claim 1, wherein the system for regulating and/or reducing the electrostatic charge comprises an electrostatic discharge system allocated to the feeding device for electrostatically discharging the web material to be fed onto the winding core accommodated by the at least one winding shaft.

3. The winding machine according to claim 1, wherein a control device allocated to the system for regulating and/or reducing an electrostatic charge is further provided, wherein the control device is configured to control the electrostatic discharge system associated with the feeding device and/or the electrostatic discharging/charging device associated with the cross-cutting device during a winding process such that an electrostatic charge on the web material is at least reduced.

4. The winding machine according to claim 3, wherein the control device is further configured to control the electrostatic charging/discharging device associated with the cross-cutting device subsequent to the cross-cutting device cutting the web material such that a new web material start is electrostatically charged for the purpose of laying the new web material start on an empty and preferably grounded winding core accommodated by the at least one winding shaft; and/or wherein the control device is further configured to control the electrostatic charging/discharging device associated with the cross-cutting device subsequent to the cross-cutting device cutting the web material such that an end of the web material is electrostatically charged for the purpose of laying the web material end on a full and preferably grounded winding core accommodated by the at least one winding shaft.

5. The winding machine according to claim 1, wherein the winding machine is designed as a turret winder and has at least two winding shafts, each of which are drivable and designed to receive a winding core, wherein the winding shafts with accommodated winding cores can be conveyed between a winding position for winding the web material onto the winding core and an unload/load position for removing a fully wound winding core or for supplying an empty winding core respectively.

6. A method for operating the winding machine of claim 1, the method comprising the following steps:

(a) the web material is wound to a maximum diameter of a first winding core, wherein the electrostatic discharge system allocated to the feeding device of the winding machine and the electrostatic discharging/charging device allocated to the cross-cutting device of the winding machine for reducing an electrostatic charge on the web material and the winding is activated during this phase;

(b) upon the maximum diameter of the winding core being reached, the winding core is conveyed to the unload/load position, wherein the web material then runs further over a second winding core accommodated on a second winding shaft and continues being wound up onto the first winding core; and (c) the cross-cutting device aids in cutting through the web material while the electrostatic discharging/charging device allocated to the cross-cutting device is simultaneously activated so as to electro-statically charge a new start of the web material.

7. The winding machine according to claim 2, wherein the winding machine further comprises a contact roller unit for feeding the web material to the winding core accommodated by the at least one winding shaft at a winding point, wherein the electrostatic discharge system allocated to the feeding device is arranged upstream, as seen in a transport direction of the web material, of the contact roller unit.

8. The winding machine according to claim 1, wherein the system for regulating and/or reducing the electrostatic charge comprises a device for detecting an amount of electrostatic charge and/or a polarity of the electrostatic charge of the web material.

9. The winding machine according to claim 8, wherein the device for detecting an amount of electrostatic charge and/or a polarity of the electrostatic charge is implemented as a component of the system for regulating and/or reducing the electrostatic charge of the web material, in a form of a sensor electrode array having at least two needle-like individual sensor electrodes.

10. The winding machine according to claim 1, wherein the electrostatic discharging/charging device is allocated a sensor system for detecting the polarity of a neutralizing current of the sensor electrode array during operation of the electrostatic discharging/charging device.

* * * * *